United States Patent [19]

Fischer et al.

[11] Patent Number: 4,585,912

[45] Date of Patent: Apr. 29, 1986

[54] CIRCUIT BREAKER, PARTICULARLY LINE-PROTECTIVE CIRCUIT BREAKER

[75] Inventors: Elmar Fischer, Regensburg; Reinhard Sangl, Wenzenbach; Paul Herma, Burglengenfeld, all of Fed. Rep. of Germany

[73] Assignee: Siemens Aktiengesellschaft, Fed. Rep. of Germany

[21] Appl. No.: 590,071

[22] Filed: Mar. 15, 1984

[30] Foreign Application Priority Data

Mar. 25, 1983 [DE] Fed. Rep. of Germany ..... 3311052

[51] Int. Cl.[4] ..... H01H 33/02; H01H 9/30

[52] U.S. Cl. ..... 200/144 R; 200/144 C; 200/147 R

[58] Field of Search ..... 200/144 R, 144 C, 147 A, 200/147 R

[56] References Cited

U.S. PATENT DOCUMENTS

| | | | |
|---|---|---|---|
| 2,337,949 | 12/1943 | Walle | 200/147 A |
| 3,021,409 | 2/1962 | Cobine et al. | 200/144 C |
| 4,393,287 | 7/1983 | Nakano | 200/144 R |

FOREIGN PATENT DOCUMENTS

| | | | |
|---|---|---|---|
| 895202 | 5/1962 | United Kingdom | 200/144 C |

*Primary Examiner*—Robert S. Macon

*Attorney, Agent, or Firm*—Scully, Scott, Murphy & Presser

[57] ABSTRACT

A circuit breaker, and particularly, though not exclusively, an automatic cut-out or line-protective circuit breaker, which includes a housing, an electric arc chamber arranged within the housing, a fixed contact and a movable contact located in the arc chamber, a current supply line forming a U-shaped current loop with the contacts. The arc-extinguishing chamber incorporates arc-extinguishing plates for guiding the path of the arc into the electric arc chamber to the extinguishing chamber, and in which plates of a magnetically-conductive material extend in parallel with the plane of contact movement up to opening or breaking thereof, and extend from the contacts to the arc-extinguishing chamber, and a gas-emitting coating being provided on each of the plates and constituted of an electrically-insulating material which emits gas when heated.

6 Claims, 4 Drawing Figures

CIRCUIT BREAKER, PARTICULARLY LINE-PROTECTIVE CIRCUIT BREAKER

BACKGROUND OF THE INVENTION

1. Field of the Invention

The present invention relates to a circuit breaker, and particularly, though not exclusively, to an automatic cut-out or line-protective circuit breaker, which includes a housing, an electric arc chamber arranged within the housing, a fixed contact and a movable contact located in the arc chamber, a current supply line forming a U-shaped current loop with the contacts. The arc-extinguishing chamber incorporates arc-extinguishing plates for guiding the path of the arc into the electric arc chamber to the extinguishing chamber, and in which plates of a magnetically-conductive material extend in parallel with the plane of contact movement up to opening or breaking thereof, and extend from the contacts to the arc-extinguishing chamber, and a gas-emitting coating being provided on each of the plates and constituted of an electrically-insulating material which emits gas when heated.

Circuit breakers of that type are generally known, for example, from German Laid-open Patent Application No. 30 30 429. In accordance therewith, in the usual manner for the guidance of the electric arc into an extinguishing chamber which is, in particular, equipped with extinguishing plates, there is obtained an electric arc guide aid in which the stationary contact and the movable contact, in conjunction with the current supply line, form a U-shaped current loop, and wherein plates of a magnetically conductive material embedded in electrically-insulating material are arranged to extend in parallel with the plane of the contact movement; for example, as is already known from German Published Patent Application No. 10 12 662 and German Patent Specification No. 480,802. In electric arc path guide aids of that type it is possible to provide a construction without the need for the additional blowout coils which were frequently employed up to that time; for instance, as in German Patent Specification No. 480802. The plates for the electric arc path guide aids are suitably provided with a coating of an electrically-insulating material, as disclosed in German Published Patent Application Nos. 10 61 866 and 10 12 662, and German Patent Application No. 914 869. Herein, it is also known that for circuit breakers with electric arc path guide aids, there could be employed a material which is gas-emitting when subjected to heat, as disclosed in German Patent Specification Nos. 914869; 11 85 274 and 280,663. Usually, guide plates are employed for the electric arc, which are frequently formed of an insulating material, which extend from the contacts to the extinguishing chamber within which there are arranged, as a rule, extinguishing plates. A construction of that type is evidenced in many of the circuit breakers which are currently being marketed.

The development of circuit breakers has led in the direction of always higher nominal or rated current intensities, a broadening of the range for instantaneous actuation, and leading to always higher switching capabilities at lower output losses and lower heat transmission values, or in other words; in the direction of a lower power conversion at the smallest dimensions and lower manufacturing costs.

The higher rated current intensities and the broadening of the range for the instantaneous actuation provide the result that the contacts must open or break at always higher current levels. Notwithstanding the usual magnetic quick-release switches with impact action on the movable contact and with electric arc drive through a blowout coil, which form the current infeed and the contacts, pursuant to current technological developments it is difficult to drive the electric arc sufficiently rapidly into the extinguishing chamber.

SUMMARY OF THE INVENTION

Accordingly, it is an object of the present invention to develop a circuit breaker of the type described in which the electric arc encounters a particularly low current resistance in the direction of its entry into the extinguishing chamber, and in which a presently known per se flow deflection technique is solved in an entirely different manner.

In order to achieve the foregoing object pursuant to the invention, sealing elements are arranged along a narrow side of the electric arc chamber and which extend from the contacts to the extinguishing chamber, wherein an air gap is provided on the oppositely-located narrow side, and wherein a seal is formed also between the plates and housing wall.

In contrast with currently known circuit breakers which provide for a feedback flow of the gases from the electric arc to rearwardly of the electric arc, pursuant to which the flow deflection lies in a plane extending perpendicular to that plane in which there takes place the contact movement; for instance, as described in French Patent No. 1194613 and German Published Patent Application No. 11 85 269, the current deflection in the circuit breaker pursuant to the present invention takes place in the plane of the contact movement. Hereby, it is particularly to be taken into consideration that the side plates which guide the electric arc can be applied closely against the electric arc, or in effect, the contacts, whereby the driving or propelling action on the electric arc becomes particularly intense. Consequently, the driving effect can also be especially intensively employed through the gas-emitting material inasmuch as a result of the particular current conditions, on the one hand, there can utilized the intensive gas flow, and on the other hand, this cannot lead to a pressure which would exceed the strength of the electric arc chamber and the contiguously located extinguishing chamber. Because of the desireably close arrangement of the plates, a flow deflection in the transverse plane of the electric arc cannot impart anything of significance.

By means of the circuit breaker pursuant to the invention, there is described a completely different way in contrast with what has been followed heretofore in the flow deflection technology. Thus, in conformance with a known solution, as is described in German Patent No. 11 85 274, in which a seal is formed in the electric arc flow direction, as viewed behind the contacts, instead thereof there are inventively provided air gaps between the contacts and the plates behind the contacts along the narrow side of the electric arc chamber.

It is advantageous that the plates in the region of the opening path of the contacts presently provide an essentially plate-shaped recess, in the context of obtaining a greater distance between the contacts and the gas-emitting coating of the plates exteriorly of the contact path. In this manner there is ensured that, under the effect of the electric arc on the gas-emitting, electrically-insulating coating of the plates, this cannot lead to any carbonization which could conceivably bridge over the contact path in the form of a leakage path. On the other hand, as a result thereof, the plates can be particularly closely arranged relative to each other. Since no flow deflection will take place behind the plates; in essence, between the plates and the housing wall, the circuit breaker can also be constructed particularly small in size.

Inasmuch as no flow deflection takes place behind the plates; in essence, between the plates and the housing wall, the plates need only to be coated along their contact side and along their edges. This renders it possible to coat the plates in a completely automatic mass-produced manner, inasmuch as they can contact the worktool along their rear side, whereby the coating can be shaped in a completely predetermined configuration.

When the plates are provided with a cutout in their recess portions, into which the material of the gas-emitting insulating layer engages or extends therethrough, then the coating can be held against the plates in a push-button-like manner. As a consequence, there can be also be dependably fastened thereto thin layers or coatings. In particular, as a result thereof, there can be increased the spacing between the contacts in the area of the plate-shaped recess.

The electric arc chamber can be particularly well sealed on one side thereof along its narrow side extending from the contact to the extinguishing chamber, in that the sealing elements are formed as a connector-like lip which is formed onto the coating of the plates, which pushes against the lip of the cooperating plate, whereby this impacting connector lip is covered by an electric arc guide rail positioned ahead thereof relative to the extinguishing chamber. Obtained thereby are different separating planes, whereby there is formed a labyrinth-like sealing arrangement.

BRIEF DESCRIPTION OF THE DRAWINGS

Reference may now be had to the following detailed description of a circuit breaker pursuant to the invention, illustrating in a generally schematic representation an exemplary embodiment, and taken in conjunction with the accompanying drawings; in which.

DETAILED DESCRIPTION

Figure 1:
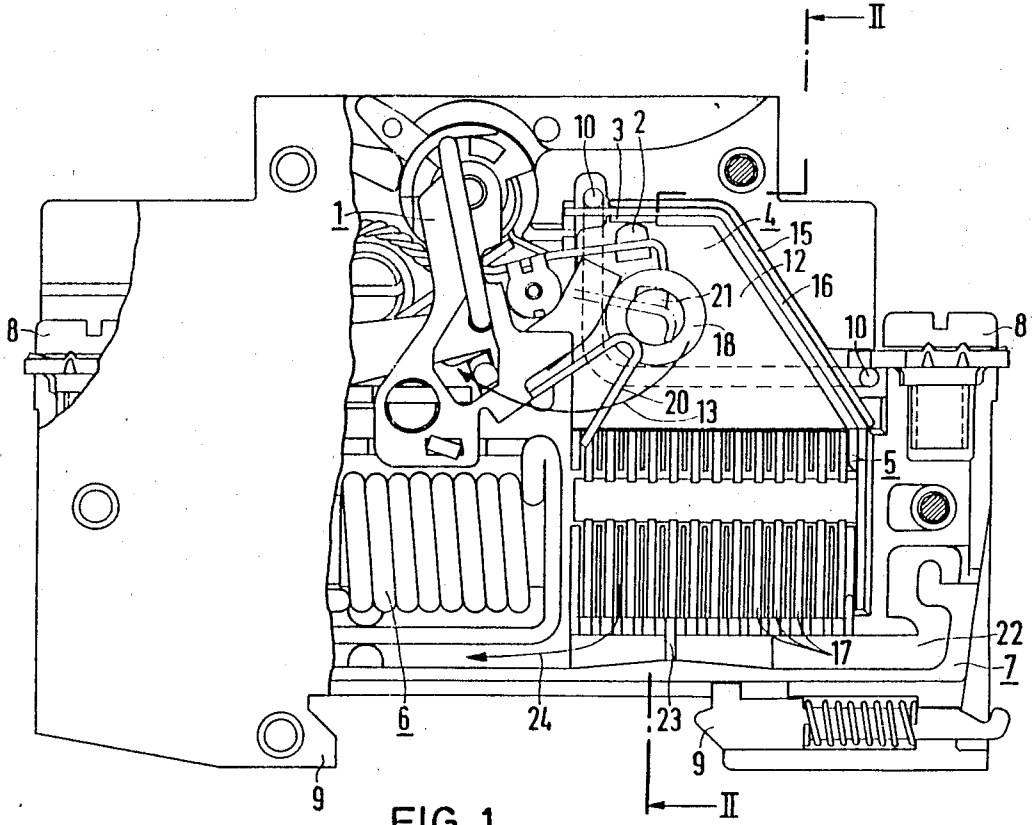
FIG. 1 illustrates a longitudinal, partly sectioned side view of a circuit breaker pursuant to the invention.

The circuit breaker according to FIG. 1, in the exemplary embodiment comprising a line-protective automatic circuit breaker, includes contacts which are actuated by a locking cam 1, the switching contact 2 and the stationary contact 3. These are arranged within an electric arc chamber 4 which extends into an arc extinguishing chamber 5. The locking cam 1, a magnetic and/or thermal triggering device 6, and the contacts 2 and 3, as well as the arc chamber 4 and the extinguishing chamber 5 are arranged within a housing 7 with the connector terminals 8 and the fastening means 9. The circuit breaker, in lieu of the automatic line-protecting circuit breaker, can also be designed as a different type of automatically activating switch; for example, as an appliance circuit breaker.

The circuit breaker incorporates different features for the guidance path of the electric arc; such as stationary contact 3 and movable switching contact 2 which jointly form, together with the power supply line 10, a U-shaped current loop. The arc guide means extends from the contacts to the extinguishing chamber and defines an upper wall and one narrow intermediate side wall of the arc chamber. On the basis of the drawing, proceeding oriented from the contacts rearwardly of the plane of the drawing, and in front of the plane of the drawing, plates of magnetically-conductive material are arranged in the electric arc chamber; in essence, in parallel with the plane of the contact movement which the contacts effectuate up to their breaking or opening. The plates 11 define opposed side walls of the arc chamber. The plates 11 of magnetically-conductive material are provided with a coating 12 of an electrically-insulating material which, when heated, is gas-emitting.

Figure 2:
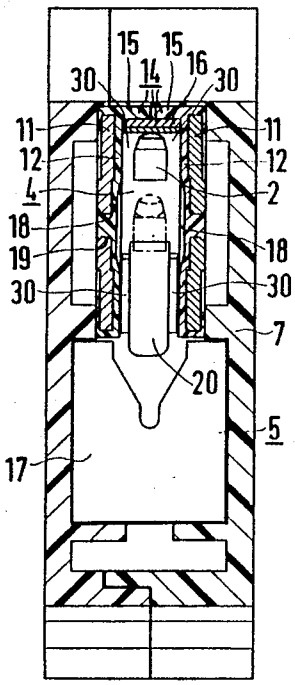
FIG. 2 illustrates a sectional view through the circuit breaker of FIG. 1 taken along line II—II.

As can be more clearly ascertained in detail from FIG. 2, a sealing arrangement is also provided between the plates 11 with the coating 12 and the wall of the housing 7; in effect, the housing wall. This sealing arrangement is formed, in accordance with FIG. 2, in that the plates have their edges rest on the housing, and are exposed at their proximately located rear side, so as to afford a full support along the edge of the plates. This sealing arrangement supports the action of the sealing elements 14 along the upper wall and one narrow side wall of the electric arc chamber 4. In the exemplary embodiment, the sealing elements 14 are each formed through a connector or web-like lip 15 which is presently formed onto the coating 12 of the plates, and which impacts against the lip of the oppositely located plate. Hereby, this contact or impact lip is covered by an electric arc guide rail 16 arranged ahead thereof, which leads one end of the electric arc into the extinguishing chamber 5 wherein, in the illustrated embodiment, there are arranged extinguishing plates 17.

Through the special arrangement of the plates 11 within the electric arc chamber 4 there is ensured that the gases, as viewed in the direction of movement of the electric arc, can flow back from ahead of the electric arc to behind the electric arc in the plane in which the contact movement takes place. This flow deflection is illustrated through the arrow 13. Hereby, in the circuit breaker pursuant to the embodiment of FIG. 1, there can be employed the known electric arc guide aid of the contact arrangement with regard to the direction of the extinguishing plates 17, which can be so described, in that the imaginary axis of the U-shaped current loop extending through the contacts stands perpendicular relative to the direction of the extinguishing plate 17.

Pursuant to a modification, in the region of the path of the breaking or opening of the contacts, the stationary contact 3 and the switching contact 2, the plates 11 incorporate essentially plate-shaped recesses or depressions 18, referring to FIG. 2, which also act as a detent in the coating 12. Achieved thereby is a greater spacing between the contacts 2 and 3 and the gas-emitting coating 12 on the plates 11 and, namely, a larger spacing than exteriorly of the breaking path of the contacts.

Through the special construction of the circuit breaker with regard to the contact configuration and, particularly, with respect to the construction of the electric arc chamber 4 with the particular flow deflection, it is sufficient that the plates 11 be coated only on their contact side and along their edges.

The plates 11, in the embodiment according to FIG. 2, include a cutout 19 in the depression 18, into which there engages the material of the gas-emitting insulating layer, or extends therethrough. Consequently, the coating 12 is fastened in the type of a pushbutton to the plates 11 in the central region of the latter.

Figure 3:
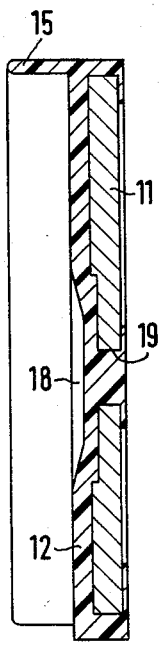
FIG. 3 illustrates an individually coated plate which serves as an electric arc guide aid, shown in cross-section.
Figure 4:
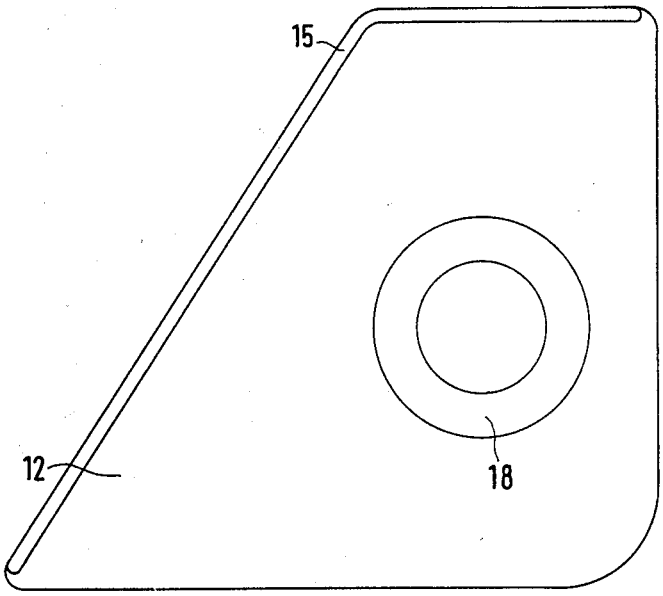
FIG. 4 illustrates a side view of the plate of FIG. 3.

Represented in cross-section in FIG. 3 is a single plate 11 with a coating 12 on which there is formed a lip 15. The connector or web-like lip 15 which is formed onto the coating is, pursuant to FIG. 4, formed along the narrow side which, in the assembled condition according to FIG. 1, forms the contemplated connection from the stationary contact 3 to the arc-extinguishing chamber 5. Air gaps 30 remain at the opposite narrow side of the electric arc chamber 4 between the movable contact 2, as well as the electric arc guide aide 20 and the coated plates 11. Further air gaps 30 for the flow deflection remain on the narrow side forming the air gaps between the individual components. The one end point of the electric arc can enter into the extinguishing chamber 5 through the electric arc guide rail 16 and the other end point of the electric arc through the arc guide aid 20. The movement of the movable contact 2 into its open position is illustrated in its intermediate position through the movable contact 21 shown in phantom lines. In the open condition, the movable contact lies with its rear side in contact against the arc guide aid 20.

The flow deflection in the plane of contact movement is supported by means of a known per se extinguishing chamber which, as viewed in the direction of movement of the electric arc, conducts gases into the open at the end of the extinguishing plates 17 not only through a gas outlet passageway 22, but because of a connector-like separator 23 also partly reconveys gases through the interior of the switch in the direction of arrow 24. Circuit breakers with such extinguishing chambers are currently being marketed, however, without an electric arc chamber which facilitates the special flow deflection with the sealing arrangement along one narrow side thereof and the sealing arrangement between the guide plates which flank the electric arc on both sides, which in ordinary switches of this type are constructed as bounding plates of ceramic or of an insulating material without a magnetically-conductive material.

What is claimed is:

1. In a circuit breaker including a housing; an arc chamber arranged within said housing; a fixed contact and a movable contact arranged in said arc chamber; a power supply line forming a U-shaped current loop with said contacts; an arc-extinguishing chamber arranged in said housing and including extinguishing plates; means for guiding the path of the arc from said arc chamber into said extinguishing chamber; said arc guide means extending from said contacts to said extinguishing chamber defining an upper wall and one narrow intermediate side wall of said arc chamber; opposed plates of a magnetically-conductive material defining opposed side walls of said arc chamber, said opposed plates extending in parallel with the plane of contact movement and extending from said contacts to said extinguishing chamber; and a gas-emitting coating being provided on each of said plates of an electrically insulating material which emits gas when heated, the improvement comprising: sealing means extending along said upper wall and said one narrow intermediate side wall of the arc chamber, said sealing means extending from said contacts to said extinguishing chamber in sealing arrangement adjacent said arc guide means, and air gaps being provided on the opposite narrow side wall of the arc chamber; and said opposed plates of magnetically-conductive material being arranged in a sealed relationship adjacent respective walls of said housing.

2. A circuit breaker as claimed in claim 1, wherein which said plates include a substantially dish-shaped depression in the area of the break path of the contacts, so as to provide a greater spacing between the contacts and gas-emitting coating on the plates than externally of the contact path.

3. A circuit breaker as claimed in claim 2, wherein said plates are coated on their contact side and along their edges.

4. A circuit breaker as claimed in claim 3, wherein each of said plates has a cutout in its dish-shaped depression, through which material from the gas-emitting coating enters or penetrates therethrough.

5. A circuit breaker as claimed in claim 1, wherein the sealing means comprises sealing members each formed by a connector-like lip formed on the gas-emitting coatings of the plates, said lip adjoining a lip on the complementary plate, and being covered by an arc guide rail up to the extinguishing chamber.

6. A circuit breaker as claimed in claim 1, wherein said circuit breaker comprises an automatic cut-out type circuit breaker.

* * * * *